US005476341A

United States Patent [19]

Johnson et al.

[11] Patent Number: 5,476,341

[45] Date of Patent: Dec. 19, 1995

[54] CONCRETE DISTRIBUTION SYSTEM

[76] Inventors: Norman E. Johnson, 410 Prospect St.; Craig O. Johnson, 400 Prospect St., both of Munising, Mich. 49862

[21] Appl. No.: 294,379

[22] Filed: Aug. 23, 1994

[51] Int. Cl.[6] ..... E01C 19/12

[52] U.S. Cl. ..... 404/101; 404/118

[58] Field of Search ..... 404/101, 108, 404/111, 118, 119; 264/31, 33; 425/64

[56] References Cited

U.S. PATENT DOCUMENTS

| | | | |
|---|---|---|---|
| 3,601,015 | 8/1971 | Kilstofte | 94/8 |
| 3,788,211 | 1/1974 | Mason, Jr. | 100/93 P |
| 4,272,935 | 6/1981 | Lukas et al. | 264/31 X |
| 4,702,640 | 10/1987 | Allen | 404/96 X |
| 4,758,114 | 7/1988 | Artzberger | 404/119 |
| 4,822,210 | 4/1989 | Oury et al. | 404/119 X |
| 4,872,823 | 10/1989 | Howard | 264/33 X |
| 5,279,500 | 1/1994 | Perrin et al. | 404/111 X |

*Primary Examiner*—Ramon S. Britts
*Assistant Examiner*—James A. Lisehora
*Attorney, Agent, or Firm*—Chase & Yakimo

[57] ABSTRACT

A concrete distribution system for pouring concrete floors over areas inaccessible to concrete trucks comprises a conduit assembly, leveling member, interconnecting cables and activating members. The conduit assembly includes a first rigid, moveable support which supports a first pipeline immediately above the area to be concreted. The pipeline has a plurality of openings through which the concrete is poured across the area. Control valves selectively open and close access to the openings so that concrete pours across the area. The first support is interconnected by cables with the leveling member. Activating members simultaneously move the conduit assembly and leveling member across the area to be concreted.

15 Claims, 4 Drawing Sheets

CONCRETE DISTRIBUTION SYSTEM

BACKGROUND OF THE INVENTION

Generally, this invention relates to a system for distributing concrete over areas that are inaccessible to concrete trucks. More specifically, the system is for pouring concrete floors over the pre-installed delicate piping systems of ice skating rinks.

SUMMARY OF THE INVENTION

Pouring the concrete floors of ice rinks and other areas that are inaccessible to concrete trucks has conventionally been done by connecting flexible piping to the truck and extending it into the ice rink or other area. The piping is supported above the area to be poured by a team of workmen. As the ice rink is being poured, the workmen carry and support the pipe across pre-installed wire mesh and the delicate refrigerated piping system.

This conventional system has many disadvantages. The system is very labor intensive and time consuming requiring a work force of at least sixteen people to pour the concrete over a period of at least fourteen hours. The piping systems can be damaged due to the force applied thereon by the workmen carrying the heavy concrete piping which results in excessive down time.

We have invented a concrete distribution system, as disclosed herein, that eliminates or reduces each of these problems. Our system includes a support which extends across the width of the ice rink or area to be concreted. The support securely holds the pipe through which the concrete is poured. This reduces the size of the necessary work force. The support slides easily across the top of delicate piping and is interconnected to a leveling screed so that both the support and screed move simultaneously across the length of the ice rink. These features reduce down time and the total time needed to pour the concrete floor.

Our new concrete distribution system comprises a conduit assembly for supplying the concrete from the truck onto the area to be concreted. The conduit assembly includes a first and second support, and first and second portions of piping. The first support and first portion of piping extend across the area. The first support is formed from a steel H-beam and includes feet or skis which slide easily across the mesh of the delicate piping systems. The first portion of piping is rigid and is coupled to the first support across its length. The first portion also has a plurality of openings therein for releasing the concrete onto the area to be concreted. The openings can be selectively opened and closed which allows the cement to be poured across the width of the ice rink. The second portion of piping is flexible and supplies the concrete from the concrete truck to the first portion of piping. The second portion of piping is supported above the ground level by a second support, which is on wheels and easily moveable. A leveling screed is spaced apart from the conduit assembly and levels the concrete released from the first portion of piping onto the ice rink. Cables interconnect the conduit assembly and the leveling screed. Winches are coupled to the conduit assembly and simultaneously move the conduit assembly and the screed across the length of the ice rink.

In use, the second flexible portion of the piping is connected at one end to the concrete truck and at the other end to the first steel portion of the-conduit assembly. As the concrete is poured from the truck, and passes from the second flexible portion into the first rigid portion of the concrete piping, the concrete pours through the openings across the width of the ice rink. Upon activation, the winches simultaneously move the system along the length of the ice rink and thus, the screed passes over the freshly poured concrete. The concrete is thereby leveled and further distributed across the width of the ice rink. This process is continued until the ice rink is completely concreted.

Accordingly, it is a general object of the invention to provide a novel concrete distribution system for areas inaccessible to concrete trucks.

Another object of the invention is to provide a concrete distribution system, as aforesaid, which is labor saving.

Still a further object of the invention is to provide a concrete distribution system, as aforesaid, which is time saving.

Another object of this invention is to provide a concrete distribution system, as aforesaid, which reduces down time.

Another object of this invention is to provide a concrete distribution system, as aforesaid, which is easily manageable and operable.

A particular object of this invention is to provide a concrete distribution system, as aforesaid, which will not damage delicate piping systems or other underflooring during the concrete pouring operation.

Other objects and advantages of this invention will become apparent from the following description taken in connection with the accompanying drawings, wherein is set forth by way of illustration and example, a now preferred embodiment of the invention.

DESCRIPTION OF THE PREFERRED EMBODIMENT

Figure 1:
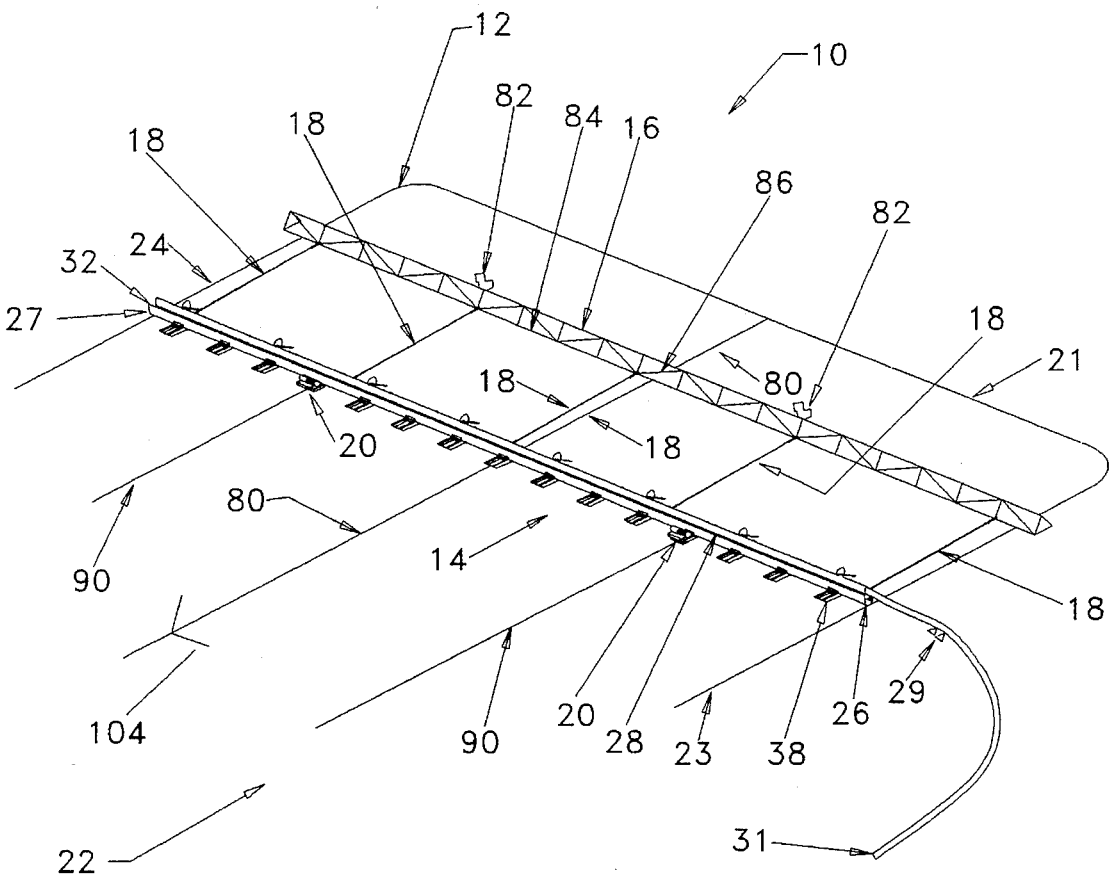
FIG. 1 is a perspective view showing the system installed on an ice rink to be paved, but with the ice rink partially broken away.
Figure 2:
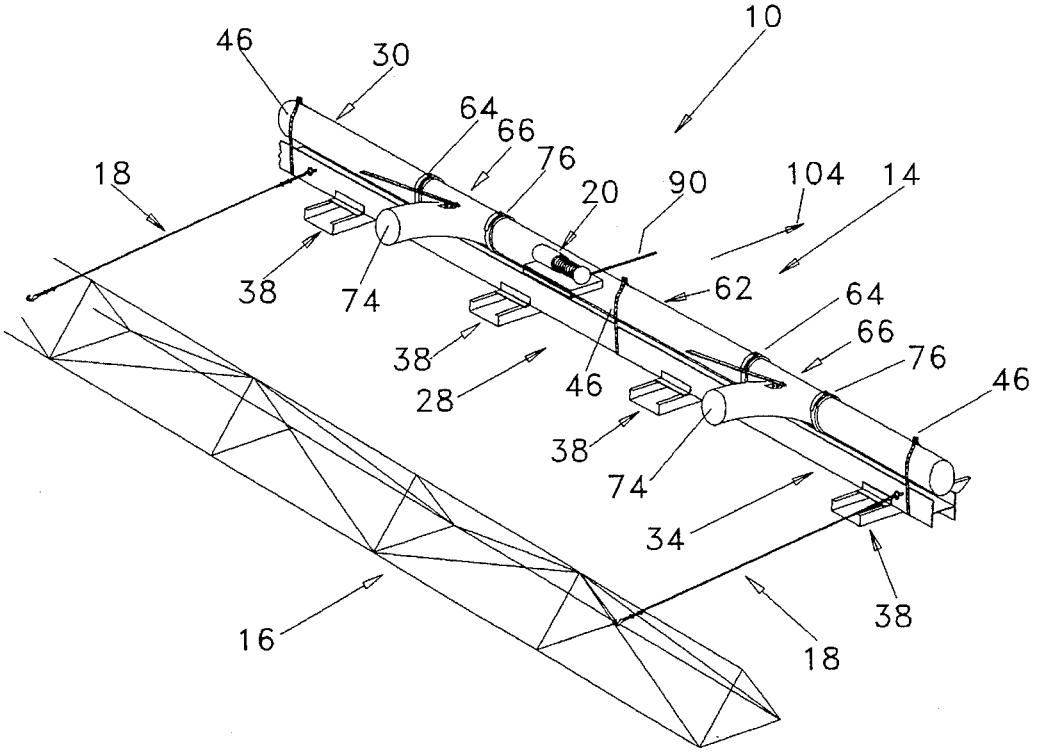
FIG. 2 is a partial perspective view of the concrete distribution system showing details of the conduit assembly in the reverse position of FIG. 1.

Turning more particularly to the drawings, FIGS. 1 and 2 illustrate the concrete distribution system 10 installed for pouring the concrete floor of ice rink 12. The concrete distribution system 10 generally comprises a conduit assembly 14 which supplies the concrete from the concrete truck onto ice rink 12. A leveling member or screed 16 is spaced apart from conduit assembly 14 for leveling the concrete poured onto ice rink 12. An interconnecting member or cable 18 couples conduit assembly 14 and leveling member 16 together. An activating member 20 is coupled to conduit assembly 14 for simultaneously moving conduit assembly 14 and leveling member 16 the length of ice rink 12.

System 10 can be used to pour any concrete floor that is inaccessible to concrete trucks and that has any configuration. However, for simplicity and clarity, system 10 will be described herein as it relates to pouring the concrete floor of an ice rink, such as ice rink 12.

Ice rink 12 is rectangular and includes a first end 21, second end 22, first side 23, and second side 24. The length of ice rink 12 extends between first and second ends 21 and 22. The width of ice rink 12 extends between first and second sides 23 and 24. First and second ends 21 and 22 are perpendicular to first and second sides 23 and 24.

As seen in FIG. 1, conduit assembly 14 includes first end 26, second end 27, first support 28, second support 29, first portion of piping 30 and second portion of piping 31. First end 26 of conduit assembly is immediately adjacent first side 23 of ice rink 12, and second end 27 of conduit assembly 14 is immediately adjacent second side 24 of ice rink 12. Preferably, conduit assembly extends parallel to first and second ends 21 and 22 of ice rink 12.

First support 28 includes primary beam 34, secondary beam 36, skis or feet 38, angle irons 40 and straps 46, as best seen in FIGS. 2–5. First support 28 extends across the width of ice rink 12 between first side 23 and second side 24. First support 28 typically rests on top of wire mesh and delicate piping previously installed over ice rink 12.

Figure 4:
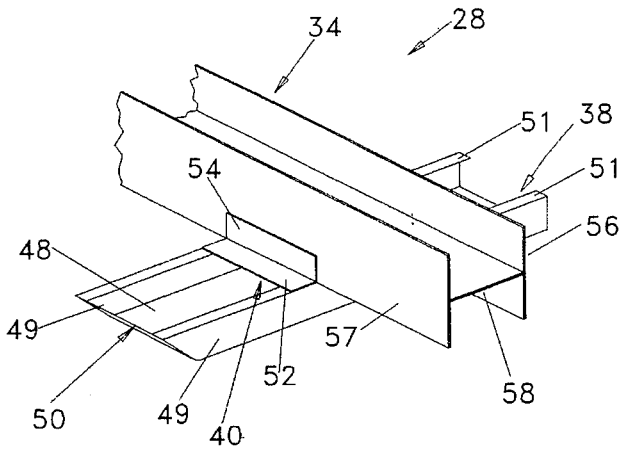
FIG. 4 is a partial perspective view of the first support of the conduit assembly, showing the skis mounted to the beam.
Figure 3:
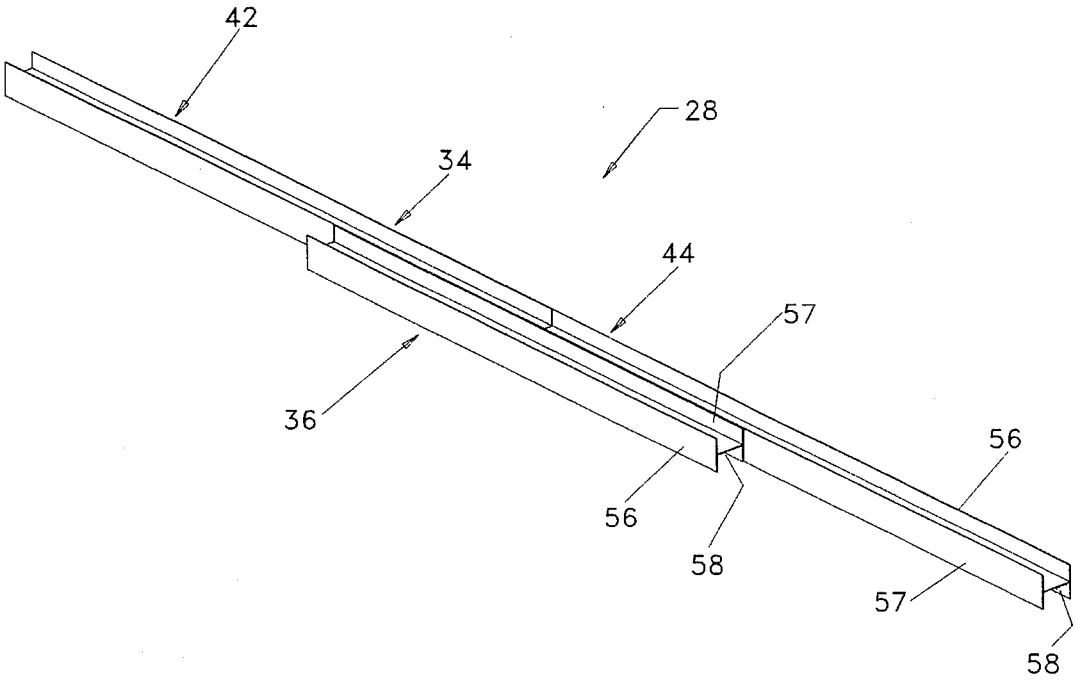
FIG. 3 is a perspective view of the first support of the conduit assembly with the skis removed for clarity.

Primary beam 34 is preferably formed of steel and is H-shaped. Beam 34 includes a first leg 56, second leg 57 and bridge portion 58 as seen in FIGS. 3 and 4. First and second legs 56 and 57 are spaced apart and parallel to each other. Bridge portion 58 is perpendicular to legs 56 and 57 and is integrally coupled at one of its sides to leg 56 and at its other side to leg 57. Primary beam 34 can comprise one long beam; however, when system 10 is being used to lay concrete over large areas, such as ice rink 12, primary beam 34 preferably comprises two H-beams 42 and 44 fixedly coupled together at one end to form one long continuous beam 34. This facilitates assembly and disassembly. As in FIG. 3, H-beams 42 and 44 are each forty feet long.

Secondary beam 36 is also H-shaped and has legs 56 and 57 and bridge portion 58 identical to primary beam 34. As in FIG. 3, secondary beam 36 is twenty-four feet long. Secondary beam 36 is preferably fixedly coupled to H-beams 42 and 44 via high strength bolts evenly spaced along leg 57 of secondary beam 36. Bolts are inserted through leg 57 of beams 42 and 44 and secured by bolts. When pouring ice rink 12, eight high strength bolts are used. Secondary beam 36 may alternatively be fixedly coupled to primary H-beams 42 and 44 by welding or in any other way that provides sufficient strength. Secondary beam 36 is fixedly coupled along legs 57 of primary H-beams 42 and 44 so that the center point of secondary beam 36 is immediately adjacent and coupled to the point at which the ends of primary H-beams 42 and 44 meet.

Skis or feet 38 support primary and secondary beams 34 and 36 and facilitate the movement of first support 28 on top of the wire mesh installed along the length of ice rink 12. Skis 38 are evenly spaced along first support 28 as seen in FIG. 1.

Figure 5:
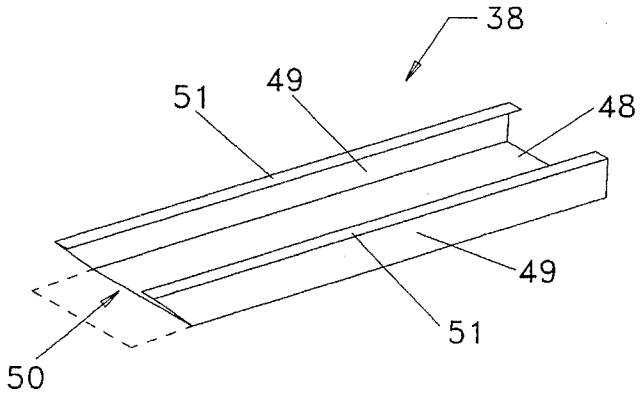
FIG. 5 is a perspective view of a ski showing how it is formed.

As best seen in FIGS. 4 and 5, skis 38 are preferably formed of steel and are C-shaped. Each ski 38 includes bottom wall or surface 48, side walls 49, leading edge 50 and flanges 51. Bottom wall 48 is preferably rectangular and engages the mesh and piping system of ice rink 12. Side walls 49 extend perpendicularly upwardly and outwardly from opposite sides of bottom wall 48. Flanges 51 extend perpendicularly from the free ends of side walls 49 toward each other and thus, are parallel and spaced apart from bottom wall 48. Flanges 51 are coplanar and form a top, discontinuous surface. Leading edge 50 extends angularly upwardly from bottom wall 48 through flanges 51 at one end of ski 38. Preferably, leading edge 50 extends at a 45° angle. Leading edge 50 improves the sliding ability of each ski 38 and is especially useful when sliding over 6 inch by 6 inch floor mesh, which is commonly used in ice skating rinks.

As seen in FIGS. 2 and 4, skis 38 are fixedly and securely coupled to primary and secondary beams 34 and 36 by angle irons 40. Angle irons 40 are preferably formed from metal, and are L-shaped. As in FIG. 4, angle irons 40 include first leg 52 and second leg 54. Both legs 52 and 54 are rectangular. Legs 52 and 54 extend perpendicularly to each other with second leg 54 fixedly coupled to and extending upwardly from one side of first leg 52. Typically, legs 52 and 54 are unitary and integrally formed. First leg 52 is coupled to flanges 51 of ski 38, and second leg 54 is coupled to second leg 57 of either primary H-beam 34 or secondary H-beam 36. Preferably , self-drilling metal tek screws are drilled through first legs 52 of angle irons 40 and flanges 51 of skis 38 to securely couple skis 38 to angle irons. Self-drilling metal tek screws are drilled through second legs 54 of angle irons 40 and legs 57 of primary or secondary beams 34 and 36 to securely couple beams 34 and 36 to angle irons 40. Alternatively, angle irons 40 can be tack welded to skis 38 and primary or secondary H-beam 34 and 36; however, this makes the disassembly of the system more difficult.

Figure 7:
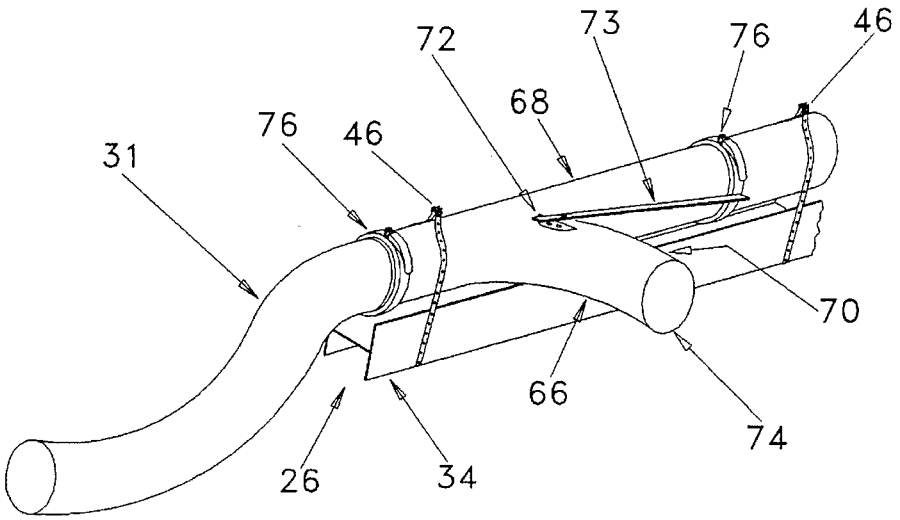
FIG. 7 is a perspective view of the first end of the conduit assembly showing the second flexible portion of the pipe connected to the first rigid portion of the pipe.
Figure 8:
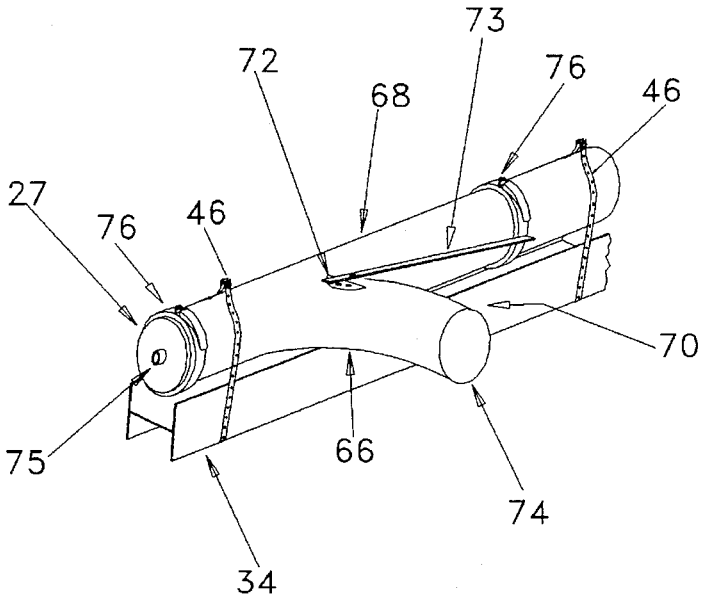
FIG. 8 is a perspective view of the second end of the conduit assembly.

Straps 46 are formed from plumber's strapping. Straps 46 secure first portion 30 of piping to primary beam 34 of first support 28, as best seen in FIGS. 2, 7 and 8. Straps 46 are preferably evenly spaced apart between first and second ends 26 and 27 of conduit assembly 14 approximately every ten feet. Straps 46 are wrapped around H-beams 42 and 44 and first portion 30 of the pipeline except where secondary beam 36 is coupled to primary beams 42 and 44 and then, straps 46 also wrap around secondary beam 36. The ends of each strap 46 are secured together by a bolt which extends through the ends of each strap 46 and receives a washer which helps tighten straps 46 around beams 36, 42 and 44.

Second support 29, as shown in FIG. 1, includes casters (not shown) and is formed of plywood which receives and supports second portion 31 of piping. Casters are preferably moveable, and each caster includes two pairs of swivel wheels. Casters are placed approximately every ten feet along second flexible portion 31 of piping. Rubber straps and hooks secure second portion 31 of piping to casters.

First portion 30 of pipeline is rigid and preferably formed from steel pipe having a four inch diameter. Although pipeline is shown as being circularly shaped, it may take any form. For instance, it could be U-shaped, like a trough. First rigid portion 30 is secured to the top side of bridge portion 58 between first and second legs 56 and 57 of primary beam 34 via straps 46, as previously discussed.

First portion 30 preferably includes a plurality of ten foot long segments 62 of piping and a plurality of T-joints 66 alternately coupled together via pipe couplers 64 to form one long continuous pipeline across the width of ice rink 12, as best seen in FIGS. 2, 7 and 8. Alternatively, first portion 30 of pipeline can be one piece of continuous piping but assembly and disassembly will be more difficult. First portion 30 of pipeline also includes cap 75 which fits securely within second end 27 of first pipeline portion 30. Cap 75 prevents concrete from pouring out second end 27.

T-joints 66 selectively allow concrete to be discharged from first portion 30 of pipeline across the width of ice rink 12. As in FIGS. 2, 7 and 8, T-joints 66 are each two feet long. T-joints 66 include main pipeline portion 68, arm portion 70, control valves 72, control valve handle 73 and openings 74. Each end of each main pipeline portion 68 of T-joint 66 is connected to one end of a first portion segment 62. Thus, segments 62 and T-joints 66 alternate the length of first portion 30 of pipeline. Arm portions 70 of T-joints 66 extend outwardly from the center point of main pipeline portions 68 toward leveling member 16 at a substantially 90° angle, thereby forming a T shape. Control valves 72 are located at the junction of main pipeline portions 68 and arm portions 70. Openings 74 are formed in the ends of arm portions 70 and allow concrete to pour out of first portion 30 of pipeline onto ice rink 12 across the width of ice rink 12.

Each control valve 72 is operated via its control valve handle 73 which is manually moved between a first and second position by one of the workmen. As handle 73 is moved, the corresponding control valve 72 simultaneously moves between an open position and a closed position. When control valve 72 is in its closed position, a through passageway extends through main pipeline portion 68 of the respective T-joint 66. When control valve 72 is in its opened position, the passageway through main pipeline portion 68 of the respective T-joint 66 is closed and thus, control valve 72 diverts concrete into arm portion 70 of that T-joint 66 and out through opening 74 onto ice rink 12.

Pipe couplers 76, as seen in FIGS. 2, 7 and 8, are tightened around the exterior circumference of the joints between segments 62 and T-joints 66 and include a rubber seal for preventing any leakage of concrete from the joints between first portion segments 62 and T-joints 66.

Second portion 31 of pipeline is preferably formed of flexible woven pipe which extends at one end from the concrete truck and is coupled at its other end to the end of first portion 30 of pipeline located at first end 26 of conduit assembly 14, as seen in FIG. 1. Preferably, twenty foot sections of flexible pipe 31 are coupled together and are supported by casters. Thus, flexible second portion 31 of pipeline is moveable with first portion 30 of pipeline along the length of ice rink 12. Specifically, as first portion 30 of pipeline is moved along the length of ice rink 12, flexible portion 31 of pipeline is able to move along the length of first side 23 of ice rink 12 due to its flexibility and the mobility of casters.

Leveling member or screed 16 as best seen in FIGS. 1 and 2, is well known in the art. Accordingly, it need not be described in detail. One screed 16 to use with system 10 is made and sold by Arrow-Master Incorporated as disclosed in Arrow-Master's Operation, Maintenance and Parts Manual for its aluminum screed AS60 and AS60H, which manual is hereby incorporated herein by reference.

Generally, as seen in FIGS. 1 and 2, screed 16 extends parallel to conduit assembly 14 across the width of ice rink 12 and is spaced at least several feet apart from conduit assembly 14. Screed 16 also extends at least a foot beyond first and second sides 23 and 24 of ice rink 12. As in FIG. 1, screed 16 exceeds its maximum span without bowing and thus, screed pipe 80 is installed at the finish floor height along the length of ice rink 12 at its center point to provide support to screed 16 and prevent it from bowing. Screed 16 is manufactured in various lengths. Ten, seven and five foot lengths are typical. Screed 16 preferably operated off of two five horsepower motors 82.

Interconnecting members or cables 18 connect conduit assembly 14 and screed 16 so that conduit assembly 14 and screed 16 move simultaneously along the length of ice rink 12. Preferably, a plurality of cables 18 are used. As seen in FIG. 1, conduit assembly 14 and screed 16 are interconnected by five evenly spaced cables 18. Hooks at the ends of cables 18 are inserted within eye bolts which are fixed to H-beams 42 and 44 and screed 16. Cables 18 can be of any material but must be sufficiently strong to withstand the forces applied by screed 16 on conduit assembly as system 10 is moved along the length of ice rink 12.

Activating members or winches 20 are common and well known and thus, need not be described in great detail. Winches 20 pull system 10 the length of ice rink 12 and are electrically operated via a 110 volt power supply. Preferably, two winches 20 are used, as seen in FIG. 1. Winches 20 allow for either forward or reverse movement of system 10 along the length of ice rink 12.

Figure 6:
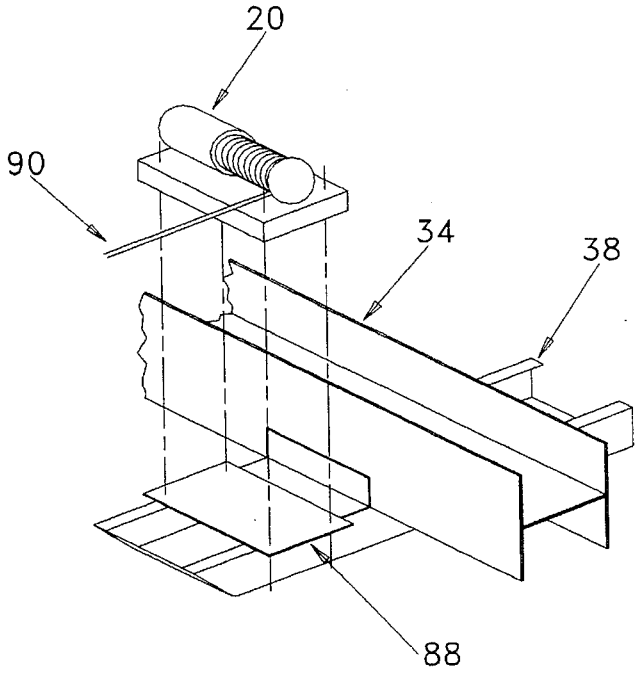
FIG. 6 is a partial perspective view of the first support showing how the winches are mounted thereon.

Winches 20 include cables 90 by which winches 20 pull system 10. Winches 20 are mounted on rectangular, flat metal mounting plates 88, as seen in FIG. 6. Mounting plates 88 are securely mounted to flanges 51 of a ski 38, which is attached to primary H-beam 34. Winches 20 are preferably spaced apart an equal distance from the center point of screed 16.

OPERATION

In operation, system 10 should initially be positioned adjacent first end 21 of ice rink, so that the concrete can be efficiently poured by moving system 10 from first end 21 to second end 22 of ice rink 12. Concrete produced from the truck flows through second flexible portion 31 of pipeline and into first portion 30 of pipeline with conduit assembly 14 positioned at first end 21 of ice rink 12. T-joints 66 are opened and closed to enable the concrete to be distributed along the width of this portion of the ice rink 12. In other words, to pour concrete toward second side 24 of ice rink 12, control valve 72 of T-joint 66 at second end 32 of conduit assembly 14 should be opened and the other control valves 72 closed so that concrete will only flow out of this T-joint's opening 74. Once that area of ice rink 12 has enough concrete, that T-joint 66 adjacent second end 32 of conduit assembly 14 can be closed and the next adjacent control valve 72 opened, thereby forcing concrete to flow out of the second opening 74 and preventing concrete from passing beyond this T-joint 66. This can be continued until concrete extends along the width of the area. Thereafter, a work force of 8 to 10 people further distribute the concrete by using concrete rakes. Winches 20 are activated and then move system 10 along the length of the ice rink 12 a predetermined distance, in the direction shown by arrows 104. As this occurs, screed 16 passes over the portion of poured concrete leveling and smoothing the concrete. Then, the process is started again. Concrete is poured from the truck through first and second portions 30 and 31 of pipeline. T-joints 66 are selectively opened and closed until concrete is distributed along the width of a second portion of ice rink 12. Winches 20 are activated to further pull system 10 along the length of the ice rink 12 so that screed 16 can level and smooth this portion of the concrete. Pouring ice rink 12 as shown in FIGS. 1 and 2, takes approximately ten hours.

It is to be understood that while certain forms of this invention have been illustrated and described, it is not limited thereto except insofar as such limitations are included in the following claims and allowable equivalents thereof.

Having thus described the invention, what is claimed as new and desired to be secured by Letters Patent is as follows:

1. An apparatus for distributing concrete over an area inaccessible by a concrete truck, comprising:

a conduit assembly for supplying the concrete from the truck onto the area, said conduit assembly including a first end, second end, first support and first portion, said first support and said first portion extending from said first end to said second end of said conduit assembly, said first portion being coupled to said first support and having at least one opening therein for releasing the concrete onto the area;

a leveling means spaced apart from said conduit assembly for leveling the concrete released onto the area from said first portion of said conduit assembly;

an interconnecting means for coupling said conduit assembly and said leveling means together; and an activating means coupled to said conduit assembly for simultaneously moving said conduit assembly and said leveling means across the area.

2. An apparatus as claimed in claim 1, wherein said conduit assembly includes a second flexible portion having a first and second end, one of said ends being adapted for coupling to the truck and the other of said ends being coupled to said first portion.

3. An apparatus as claimed in claim 2, wherein said first portion of said conduit assembly is a metal pipe.

4. An apparatus as claimed in claim 2, wherein said first portion includes a plurality of openings for distributing concrete across the area.

5. An apparatus as claimed in claim 4, wherein said plurality of openings can be selectively opened and closed to regulate discharge of concrete from said openings.

6. An apparatus as claimed in claim 1, wherein said first support includes a metal beam, said first portion of said conduit assembly being coupled thereto.

7. An apparatus as claimed in claim 6, wherein said first support includes a plurality of feet having a top surface and a bottom surface, said top surface being fixedly coupled to said beam and said bottom surface slidable over the area.

8. An apparatus as claimed in claim 7, wherein said feet have an angled front edge to facilitate sliding over the area.

9. An apparatus as claimed in claim 7, wherein said activating means includes a plurality of winches, each one of said winches being coupled to one of said feet.

10. An apparatus as claimed in claim 1, wherein said interconnecting means includes a plurality of cables spaced evenly apart between said first end and said second end of said conduit assembly, each of said cables being coupled to said conduit assembly at one end and said leveling means at the other end.

11. An apparatus as claimed in claim 2, wherein said leveling means includes a support pipe and a screed, said support pipe supporting said screed.

12. An apparatus for distributing and screed leveling concrete over an area inaccessible by a concrete truck comprising:

a conduit assembly for supplying the concrete onto the area, said conduit assembly including a first end, second end, first support, first pipeline portion and second pipeline portion;

a plurality of cable members interconnecting said conduit assembly and the screed;

an activating means coupled to said conduit assembly for simultaneously moving said conduit assembly and the screed across the area;

said first support including a plurality of beams and feet, said beams fixedly secured together and extending substantially from said first conduit assembly end to said second conduit assembly end, said feet being securely coupled to said beams and being spaced apart between said first and said second conduit assembly ends for facilitating a slidable movement of said first support across the area;

said first pipeline portion being rigid and coupled to said beams substantially from said first conduit assembly end to said second conduit assembly end and having a plurality of openings therein through which the concrete is distributed onto the area; and said second pipeline portion being flexible and having an end coupled to an end of said first pipeline portion and the other end of said second pipeline portion being adapted for coupling to the truck.

13. An apparatus as claimed in claim 12, further comprising:

a second support upon which said second pipeline portion is mounted, said second support being mobile for movement with said conduit assembly.

14. An apparatus as claimed in claim 12, wherein said first pipeline portion includes a plurality of first segments and a plurality of second segments, each of said second segments include a main pipeline leg, a second leg and a control valve, each of said main pipeline legs have a first end and a second end and are coupled at each end to an end of one of said first segments, each of said second legs extend outwardly from one of said main pipeline legs, each of said control valves are located within one of said second segments at the junction of said main pipeline leg and said second leg, and each of said control valves having a closed position for concrete flow along said first pipeline portion and an open position for flow of concrete into said second leg and through said opening onto the area.

15. An apparatus as claimed in claim 14, wherein said first segments and said second segments are alternately coupled together.

* * * * *